US007718935B2

(12) United States Patent
von Buren et al.

(10) Patent No.: US 7,718,935 B2
(45) Date of Patent: May 18, 2010

(54) APPARATUS AND METHOD FOR INDUCTIVE HEATING OF A MATERIAL IN A CHANNEL

(75) Inventors: Stefan von Buren, Colchester, VT (US); Kyle B. Clark, Underhill, VT (US)

(73) Assignee: iTherm Technologies, LP, Merrimack, NH (US)

( * ) Notice: Subject to any disclaimer, the term of this patent is extended or adjusted under 35 U.S.C. 154(b) by 606 days.

(21) Appl. No.: 11/505,059

(22) Filed: Aug. 16, 2006

(65) Prior Publication Data

US 2008/0217325 A1 Sep. 11, 2008

(51) Int. Cl.
*H05B 6/10* (2006.01)

(52) U.S. Cl. ..... 219/628; 219/494; 219/643; 425/174.8 R; 264/472

(58) Field of Classification Search ..... 219/505, 219/494, 497, 635, 644, 643, 667; 425/174–175; 264/403, 472, 486; 164/113, 312–318, 900
See application file for complete search history.

(56) References Cited

U.S. PATENT DOCUMENTS

| | | | |
|---|---|---|---|
| 1,852,215 | A | 4/1932 | Northhrup |
| 2,829,227 | A | 4/1958 | Antonis |
| 2,875,311 | A | 2/1959 | Harkenrider |
| 2,947,045 | A | 8/1960 | Goldhamer |
| 3,376,403 | A | 4/1968 | Mircea |
| 3,536,983 | A | 10/1970 | Kennedy |
| 3,620,294 | A | 11/1971 | Hetzel |
| 4,704,509 | A | 11/1987 | Hilmersson et al. |
| 5,012,487 | A | 4/1991 | Simcock |
| 5,101,086 | A | 3/1992 | Dion et al. |
| 5,385,200 | A | 1/1995 | Yuki et al. |
| 5,713,069 | A | 1/1998 | Kato |
| 5,902,509 | A | 5/1999 | Bruckner et al. |
| 6,011,245 | A * | 1/2000 | Bell ..... 219/631 |

(Continued)

FOREIGN PATENT DOCUMENTS

| | | |
|---|---|---|
| DE | 965761 | 6/1957 |

(Continued)

OTHER PUBLICATIONS

International Search Report and Written Opinion mailed Dec. 20, 2007 in corresponding application Serial No. PCT/US2007/018125.

(Continued)

*Primary Examiner*—Mark H Paschall
(74) *Attorney, Agent, or Firm*—Rissman, Hendricks & Oliverio, LLP

(57) ABSTRACT

Apparatus and method for inductive heating of a material located in a channel. In one embodiment, the heating assembly comprises an interior coil, an exterior sheath inductively coupled to the coil, a dielectric material disposed between the coil and sheath, and a conductor for supplying a signal to the coil to generate the magnetic flux for inductive heating of the sheath. The heating assembly is disposed in the material in the channel, and the magnetic flux generated by the coil may also inductively couple to the material in the channel. The material may be heated from a nonflowable to a flowable state, such as heating a metal or polymer plug formed in a melt channel of a molding apparatus.

15 Claims, 4 Drawing Sheets

U.S. PATENT DOCUMENTS

| | | | | |
|---|---|---|---|---|
| 6,084,225 | A | 7/2000 | Schmitt | |
| 6,460,596 | B1 | 10/2002 | Yamaguchi et al. | |
| 6,546,039 | B2 | 4/2003 | Fishman | |
| 6,580,896 | B2 * | 6/2003 | Lee | 399/330 |
| 6,798,822 | B2 | 9/2004 | Fishman et al. | |
| 6,892,970 | B2 | 5/2005 | Nussio | |
| 7,034,263 | B2 | 4/2006 | Kagan | |
| 7,034,264 | B2 | 4/2006 | Kagan | |
| 7,049,562 | B2 | 5/2006 | Tanino et al. | |
| RE39,291 | E | 9/2006 | Kestle et al. | |
| 7,140,873 | B1 | 11/2006 | House | |
| 2002/0189781 | A1 | 12/2002 | Shibata et al. | |
| 2003/0057201 | A1 | 3/2003 | Johnson | |
| 2003/0067376 | A1 | 4/2003 | Maenosoni | |
| 2003/0132224 | A1 | 7/2003 | Spencer | |
| 2004/0028111 | A1 | 2/2004 | Fishman et al. | |
| 2004/0084171 | A1 | 5/2004 | Akers et al. | |
| 2005/0191098 | A1 | 9/2005 | Ueno et al. | |
| 2006/0076338 | A1 | 4/2006 | Kagan | |
| 2006/0093413 | A1 | 5/2006 | Matsumoto | |

FOREIGN PATENT DOCUMENTS

| | | | |
|---|---|---|---|
| DE | 965761 | C | 6/1957 |
| DE | 3118030 | A1 | 12/1982 |
| DE | 102005021238 | A1 | 11/2006 |
| EP | 0403138 | A | 12/1990 |
| GB | 508255 | A | 6/1939 |
| JP | 1-170547 | | 7/1989 |
| JP | 401313134 | A | 12/1989 |
| JP | 2004 108666 | A | 4/2004 |
| JP | 2005 259558 | | 9/2005 |

OTHER PUBLICATIONS

International Search Report and Written Opinion mailed Dec. 28, 2007 in related application Serial No. PCT/US2007/018113 (U.S. Appl. No. 11/505,032).

International Search Report and Written Opinion mailed Mar. 26, 2008 in a related application Serial No. PCT/US2007/018041 (U.S. Appl. No. 11/505,023).

International Search Report and Written Opinion mailed Apr. 24, 2008 in a related application Serial No. PCT/US2007/018171 (U.S. Appl. No. 11/505,022).

Office Action dated Sep. 17, 2008 under U.S. Appl. No. 11/505,032.

Office Action dated Jul. 11, 2008 under U.S. Appl. No. 11/505,022.

* cited by examiner

APPARATUS AND METHOD FOR INDUCTIVE HEATING OF A MATERIAL IN A CHANNEL

FIELD OF THE INVENTION

This invention relates to an apparatus and method for inductive heating of a material located in a channel, wherein a heating assembly is disposed in the material in the channel and includes an interior coil which generates a magnetic flux for inductively heating an exterior sheath of the assembly, and may also inductively couple to and heat the material in the channel.

BACKGROUND OF THE INVENTION

It is common practice to inductively heat an article (e.g., a solid cylinder or hollow tube) of a magnetizable material, such as steel, by inducing an eddy current in the article. This eddy current is induced by an applied magnetic flux generated by passage of an alternating current through a heater coil wound around the article. The heat inductively generated in the article may then be transmitted to another article, e.g., a metal or polymer material flowing through a bore or channel of an inductively heated steel tube.

Various systems have been proposed which utilize different combinations of materials, structural heating elements, resonant frequencies, etc., for such heating techniques. There is an ongoing need for an apparatus and method for heating a material in a channel which provides one or more of higher power density, tighter temperature control, reduced power consumption, longer operating life, and/or lower manufacturing costs.

SUMMARY OF THE INVENTION

In accordance with one embodiment of the invention, a method is provided for heating a material located in a channel. The method includes steps of providing an internal inductive heating assembly in the material in the channel, the heating assembly comprising an exterior sheath disposed in contact with the material and an interior coil inductively coupled to the sheath. The method further includes supplying a signal to the coil to generate a magnetic flux for inductive heating of the sheath, wherein the material is heated by conductive heat transfer from the sheath.

In one embodiment, the coil may also be inductively coupled to the material such that the magnetic flux generates inductive heating of the material (as well as the sheath).

In various applications, the material may be heated from a nonflowable to the flowable state. The nonflowable state may be one or more of a physically rigid solid state and a semi-rigid solid state. The flowable state may be one or more of a liquid state and a semi-solid state. In one embodiment, the material is heated from a semi-rigid state to a flowable state. In another embodiment, the material is heated from a rigid state to a flowable state.

More generally, the material may be heated in order to produce a change in its viscosity.

The method may further include cooling of the material. In one embodiment, the channel is provided in an outer element which conductively cools the material. The heating and cooling may be provided intermittently, at regular periodic or nonperiodic intervals. The signal supplied to the coil may be adjusted to provide an alternating heating and cooling cycle.

In various applications, the material is one or more of a metal and a polymer. The material may be one or more of an electrically conductive, ferromagnetic, electrically nonconductive, thermally insulating, and thermally conductive material.

The configuration of the coil and sheath may be adapted for minimizing heating of the coil in order to maintain the coil temperature within an operating limit.

In various embodiments, the coil and sheath may be in thermal contact enabling transmission of heat from the coil to the sheath. The relative temperatures of the coil, sheath and material may vary. Often the coil will be at a highest temperature, the sheath at a lower temperature, and the material at a lowermost temperature.

The signal supplied to the coil may comprise current pulses providing high frequency harmonics in the coil. This signal is particularly useful in systems having a high damping coefficient which are difficult to drive (inductively) with sustained resonance.

In a further embodiment, a method is provided for heating a material located in a channel. The method includes steps of providing an internal inductive heating assembly in the material in the channel, the heating assembly comprising an exterior sheath disposed in contact with the material and an interior coil inductively coupled to the sheath. The method further includes supplying a signal to the coil to generate a magnetic flux for inductive heating of the sheath and/or the material.

In accordance with another embodiment of the invention, a heating assembly is provided comprising an interior coil, an exterior sheath inductively coupled to the coil, a dielectric material disposed between the coil and the sheath, and a conductor for supplying a signal to the coil to generate a magnetic flux for inductive heating of the sheath.

Preferably, a flux concentrator may be provided to increase the inductive coupling between the coil and the sheath. For example, the flux concentrator may be disposed inside the coil.

These and other features and/or advantages of several embodiments of the invention may be better understood by referring to the following detailed description in conjunction with the accompanying drawings.

DETAILED DESCRIPTION

Figure 1:
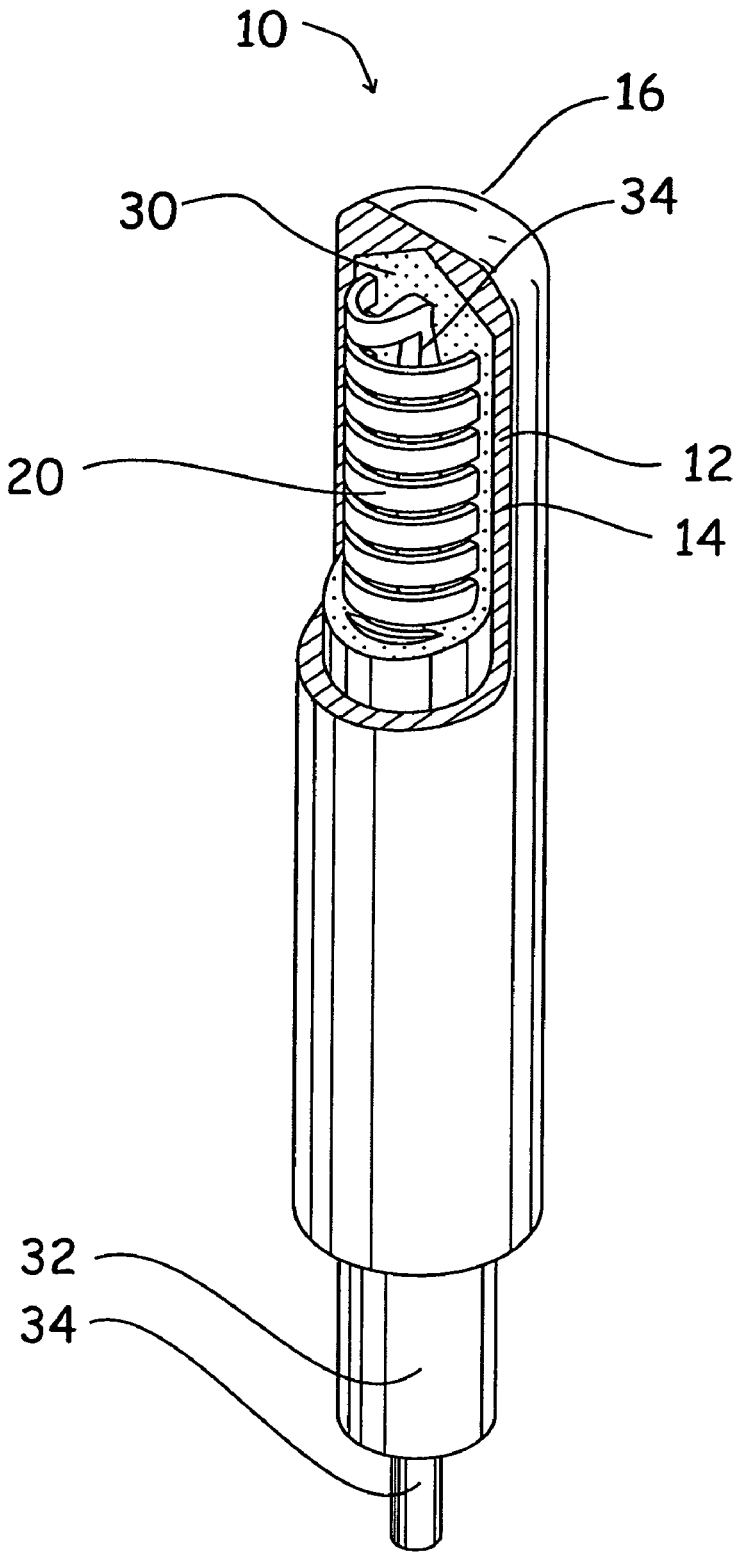
FIG. 1 is a schematic view of a probe heater according to one embodiment of the invention, including a partial cut-away view showing the interior inductive coil and dielectric insulation inside the outer ferromagnetic sheath.

A first embodiment of the invention is illustrated in FIG. 1. An inductive heating assembly, herein referred to as a probe heater 10, is provided having a generally elongated profile and adapted to be disposed in a channel (see FIGS. 3-4) for heating of a material in the channel. The heating assembly includes a generally cylindrical exterior ferromagnetic sheath 12 having a hollow interior 14 and being closed at one end 16. Within the hollow interior of the sheath is a heating element or inductor coil 20, here provided as a substantially helical coil extending along an axial length of the sheath. Dielectric insulation 30 is provided in and around the coil, including between the individual turns of the coil, for electrically isolating the coil 20 from the sheath 12. The coil has coaxial power leads, including an outer cylindrical lead 32 connecting to one end of the coil, and a central axial lead 34 connecting to the other end of the coil and extending along the cylindrical axis of the coil/assembly.

Figure 2:
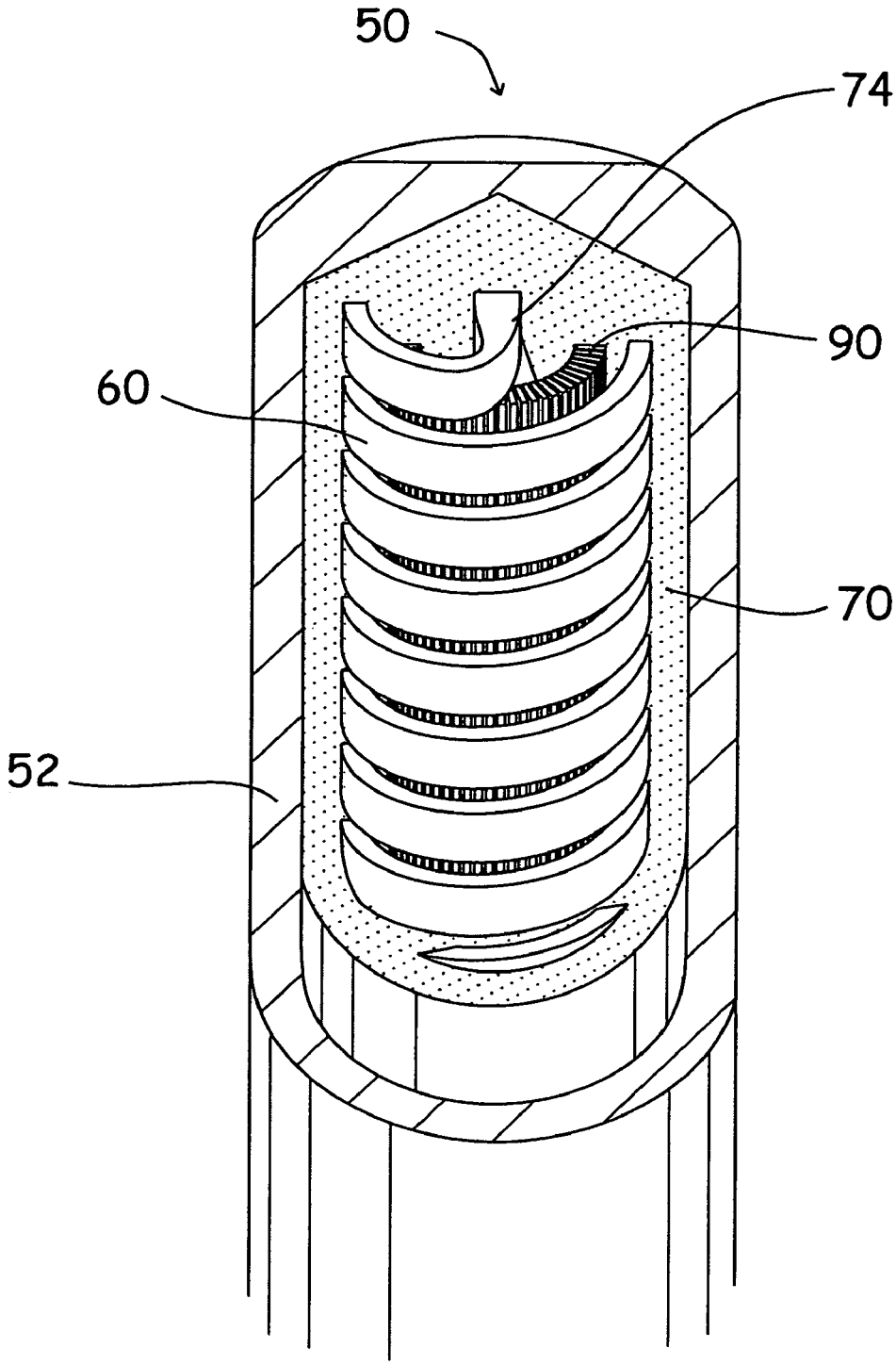
FIG. 2 is an expanded, partial cut-away view of another embodiment of a probe heater according to one embodiment of the invention, further including a flux concentrator disposed radially interior to the inductor coil.

FIG. 2 illustrates a second embodiment of a heater probe 50 which is similar to the first embodiment but further includes a ferromagnetic flux concentrator for closing the magnetic loop with the outer sheath. Similar to FIG. 1, the heating assembly of FIG. 2 includes an outer ferromagnetic sheath 52, a coiled heating element 60, dielectric insulation 70, and concentric power leads (return lead 74 is shown). The assembly further includes a substantially cylindrical flux concentrator 90 concentrically disposed within the coil 60 and extending axially along a length of the heating assembly. This high permeability flux concentrator enhances the magnetic field by forming a closed magnetic loop with the exterior sheath 52, thus increasing the magnetic coupling between the coil 60 and sheath 52. The flux concentrator preferably has an open current loop (e.g., slotted as shown) to reduce the eddy currents (and thus heat) generated in the flux concentrator.

Figure 3:
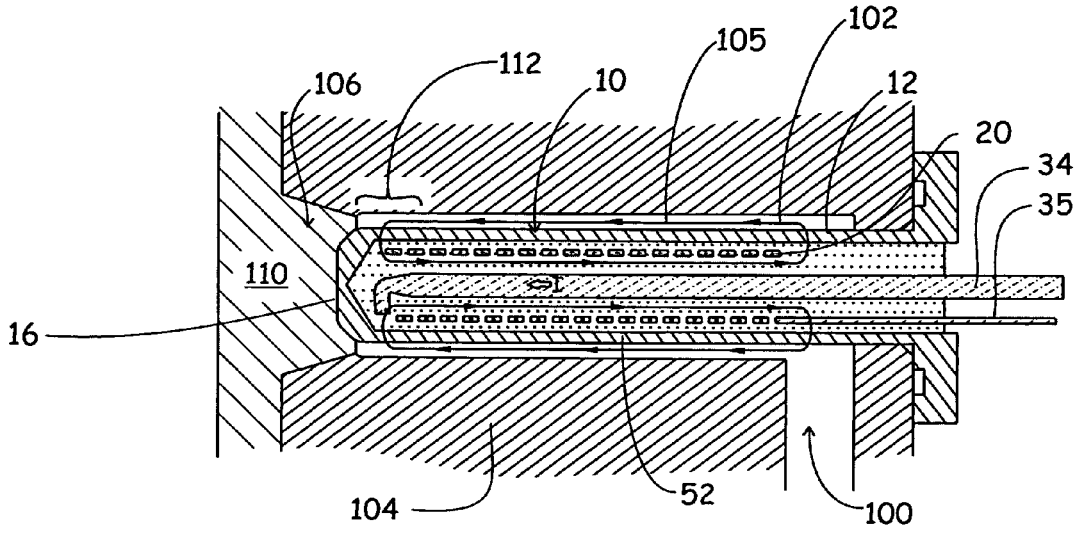
FIG. 3 is a schematic cross-sectional view of a probe heater similar to that shown in FIG. 1, disposed at the gate end of an injection molding system, illustrating use of a probe heater to melt a plug formed adjacent the gate area.

FIG. 3 illustrates one application of the heating assembly of FIG. 1 disposed in a channel 102 (a tubular passage or conduit for a flowable material), the channel being located in an outer element 104. The outer element 104 may be, for example, a mold insert, a hotrunner manifold or a nozzle, having a melt channel 102 through which a flowable material 100, such as a conductive liquid metal, is adapted to flow. The channel at one end of the outer element has a tapered region or gate area 106, also referred to as a separation area, enabling a molded part 110, formed in the gate area 106 and in an adjacent mold cavity 120, to be separated from the material remaining in the melt channel 102. The flowable material travels through the channel toward the gate 106 and into the mold cavity, where it is cooled to a nonflowable solid state and forms a molded part 110. In order to provide a clean break at the gate (preferably no drool from the gate), the material in the channel area 112 adjacent to the gate area 106 must be cooled from a flowable (e.g., liquid or semi-solid state) to a nonflowable (e.g., physically rigid or semi-rigid (deformable) state). The nonflowable material which forms and remains in the channel area 112 adjacent to gate 106, is typically referred to as a plug. Formation of a plug thus enables the clean separation of the solidified material in the gate area 106 (the molded part) when the mold is opened (e.g., a mold core is moved away from the opposite side of the mold). Cooling of the material in channel area 112 adjacent the gate region can be accomplished by thermal conduction, e.g. by conduction of heat toward the molded part 110 (which is in contact with the cooler mold core and cavity walls); by providing an additional cooling medium at or near the gate area 106 to draw heat away from the material in channel area 112; and/or by any other process parameter(s) which reduce the temperature of the material in channel area 112.

During a next molding cycle, the nonflowable plug must again be heated to a fluid (flowable) state. For this purpose, an inductive heating assembly (probe heater 10) is positioned in the material in the channel 102, with the closed end 16 of the outer sheath disposed at or near the separation area 106. The probe heater 10 is centrally disposed in the channel 102 and is surrounded by a relatively narrow annular width of open channel area. A plug of material will be formed around the sheath in the area 112 at the gate end of the channel. In order to melt the plug (reduce its viscosity) so that material can again be injected through the gate, a magnetic field (see lines 105) is generated by the interior coil 20 of the probe which is transmitted to one or more of the exterior sheath 52 and the material 100 in the channel for inductive heating of the sheath and/or material respectively. The plug is thus heated and converts back to a fluid state, allowing the material to flow around the exterior sheath and exit through the gate 106.

Figure 4:
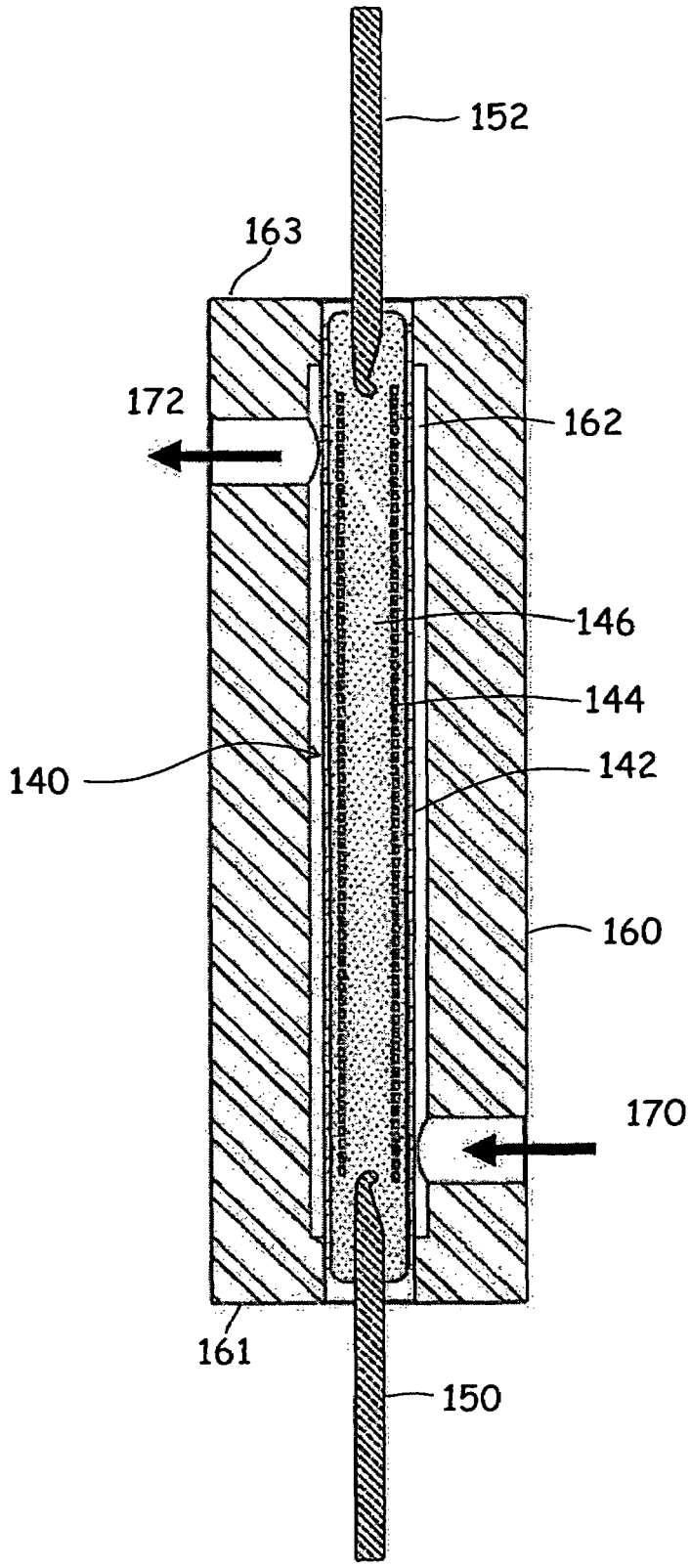
FIG. 4 is a schematic cross-sectional view of an alternative embodiment of a probe heater according to the invention, disposed in a channel of a manifold, wherein the probe heater has power leads disposed at opposing ends of the heater assembly.

FIG. 4 illustrates a third type of heating assembly or probe for heating (which as used herein includes adjusting, controlling and/or maintaining the temperature of) a fluid material traveling through a channel 162 in a manifold 160. The heater probe 140 is similar to the type illustrated in FIG. 1, having an interior induction coil 144, dielectric insulation 146, and outer ferromagnetic sheath 142. However in this embodiment, the power leads 150, 152 are disposed at opposing ends 161, 163 respectively of the elongated probe. A fluid material, such as a polymer or metal, is heated prior to entry (at 170) into the manifold channel. The heating assembly is centrally disposed along some axial length of the channel 162, between entrance 170 and exit 172 ports of the channel. An annular flow path is provided around the heating assembly, within the channel, allowing the fluid to travel along this path and in contact with the sheath. A magnetic flux generated by the coil is transmitted to the outer ferromagnetic sheath 142 and/or fluid material (if conductive) for inductively heating the sheath and/or material or otherwise adjusting or maintaining the temperature of the fluid material.

The probe heater according to the present invention is not limited to specific materials, shapes or configurations of the components thereof. A particular application or environment will determine which materials, shapes and configurations are suitable.

For example, the inductor coil may be one or more of nickel, silver, copper and nickel/copper alloys. A nickel (or high percentage nickel alloy) coil is suitable for higher temperature applications (e.g., 500 to 1,000° C.). A copper (or high percentage copper alloy) coil may be sufficient for lower temperature applications (e.g., <500° C.). The coil may be stainless steel or Inconel (a nickel alloy). In the various embodiments described herein, water cooling of the coil is not required nor desirable.

The power leads supplying the inductor coil may comprise an outer cylindrical supply lead and an inner return lead concentric with the outer cylindrical supply lead. The leads may be copper, nickel, Litz wire or other suitable materials.

The dielectric insulation between the inductor coil and outer ferromagnetic sheath may be a ceramic such as one or more of magnesium oxide, alumina, and mica. The dielectric may be provided as a powder, sheet or a cast body surrounding the coil.

The coil may be cast on a ceramic dielectric core, and a powdered ceramic provided as a dielectric layer between the coil and sheath.

The coil may be cast in a dielectric ceramic body and the assembly then inserted into the sheath.

The sheath may be made from a ferromagnetic metal, such as a 400 series stainless or a tool steel.

The flux concentrator may be provided as a tubular element disposed between the coil and the return lead. The flux concentrator may be a solid, laminated and/or slotted element. For low temperature applications, it may be made of a non-electrically conductive ferromagnetic material, such as ferrite. For higher temperature applications it may comprise a soft magnetic alloy (e.g., cobalt).

The coil geometry may take any of various configurations, such as serpentine or helical. The coil cross-section may be flat, round, rectangular or half round. As used herein, coil is not limited to a particular geometry or configuration; a helical wound coil of flat cross section as shown is only one example.

In a more specific embodiment, given by way of example only and not meant to be limiting, the probe heater may be disposed in a melt channel for heating magnesium. The heater may comprise a tool steel outer sheath, a nickel coil, an alumina dielectric, and a cobalt flux concentrator. The nickel coil, steel sheath and cobalt flux concentrator can all withstand the relatively high melt temperature of magnesium. The nickel coil will generally be operating above its Curie Temperature (in order to be above the melt temperature of the magnesium); this will reduce the "skin-effect" resistive heating of the coil (and thus reduce over-heating/burnout of the coil). The steel sheath will generally operate below its Curie Temperature so as to be ferromagnetic (inductively heated), and will transfer heat by conduction to raise the temperature of the magnesium in which it is disposed (during heat-up and/or transient operation). The sheath may be above its Curie Temperature once the magnesium is melted, e.g., while the magnesium is held in the melt state (e.g., steady state operation or temperature control). The coil will be cooled by conductive transmission to the sheath. Preferably the Curie Temperature of the flux concentrator is higher than that of the sheath, in order to maintain the permeability of the flux concentrator, close the magnetic loop, and enhance the inductive heating of the sheath.

Again, the specific materials, sizes, shapes and configurations of the various components will be selected depending upon the particular material to be heated, the cycle time, and other process parameters.

In various applications of the described inductive heating method and apparatus, it may generally be desirable that the various components have the following properties:

- the coil is electrically conductive, can withstand a designated operating temperature, and is paramagnetic at the operating temperature;
- the sheath is ferromagnetic at the desired operating temperature, is thermally conductive, is electrically conductive, and has a relatively uninterrupted path for the eddy current to flow;
- the dielectric material is electrically insulative, thermally conductive, and substantially completely paramagnetic;
- the flux concentrator does not exceed its Curie point during operation, has a high permeability, can withstand high operating temperatures, and has an interrupted (restricted) circumferential path for the eddy current to flow;
- the material is in good thermal contact with the sheath.

In applications where there is direct coupling of the magnetic field to the material, the desired parameters of the sheath are also desired parameters of the material.

The material in the channel to be heated will also effect the parameters of the assembly components, the applied signal and the heating rates. In various embodiments, the material may include one or more of a metal and a polymer, e.g., a pure metal, a metal alloy, a metal/polymer mixture, etc. In other embodiments the assembly/process may be useful in food processing applications, e.g., where grains and/or animal feed are extruded and cooled.

In various applications, it may be desirable to supply a signal to the coil comprising current pulses having a desired amount of pulse energy in high frequency harmonics for inductive heating of the sheath, as described in Kagan U.S. Pat. Nos. 7,034,263 and 7,034,264, and in Kagan U.S. Patent Application Publication No. 2006/0076338 A1, published Apr. 13, 2006 (U.S. Ser. No. 11/264,780, entitled Method and Apparatus for Providing Harmonic Inductive Power). The current pulses are generally characterized as discrete narrow width pulses, separated by relatively long delays, wherein the pulses contain one or more steeply varying portions (large first derivatives) which provide harmonics of a fundamental (or root) frequency of the current in the coil. Preferably, each pulse comprises as least one steeply varying portion for delivering at least 50% of the pulse energy in the load circuit in high frequency harmonics. For example, the at least one steeply varying portion may have a maximum rate of change of at least five times greater than the maximum rate of change of a sinusoidal signal of the same fundamental frequency and RMS current amplitude. More preferably, each current pulse contains at least two complete oscillation cycles before damping to a level below 10% of an amplitude of a maximum peak in the current pulse. A power supply control apparatus is described in the referenced patents/application which includes a switching device that controls a charging circuit to deliver current pulses in the load circuit so that at least 50% (and more preferably at least 90%) of the energy stored in the charging circuit is delivered to the load circuit. Such current pulses can be used to enhance the rate, intensity and/or power of inductive heating delivered by a heating element and/or enhance the lifetime or reduce the cost in complexity of an inductive heating system. They are particularly useful in driving a relatively highly damped load, e.g., having a damping ratio in the range of 0.01 to 0.2, and more specifically in the range of 0.05 to 0.1, where the damping ratio, denoted by the Greek letter zeta, can be determined by measuring the amplitude of two consecutive current peaks $a_1$, $a_2$ in the following equation:

$$\zeta = \frac{-\ln\left(\frac{a_2}{a_1}\right)}{2\pi}$$

This damping ratio, which alternatively can be determined by measuring the amplitudes of two consecutive voltage peaks, can be used to select a desired current signal function for a particular load. The subject matter of the referenced Kagan patents/application are hereby incorporated by reference in their entirety.

These and other modifications will be readily apparent to the skilled person as included within the scope of the following claims.

The invention claimed is:

1. A method of heating a flowable material traveling through a channel, the method comprising:

providing an internal inductive heating assembly in the flowable material traveling through the channel, the heating assembly comprising an exterior sheath disposed in contact with the flowable material and an interior coil inductively coupled to the sheath;

wherein the coil and sheath are in thermal communication enabling transmission of heat from the coil to the sheath; and supplying a signal to the coil to generate a magnetic flux for inductive heating of the sheath, wherein the flowable material traveling through the channel is heated by conductive heat transfer from the sheath;

cooling the material in one area of the channel from the flowable to a nonflowable state; and during a next cycle, heating the material in the one area from a nonflowable to a flowable state.

2. The method of claim 1, wherein the coil is inductively coupled to the material and the magnetic flux generates inductive heating of the material.

3. The method of claim 1, wherein the nonflowable state is a solid state and the flowable state is one or more of a semi-solid state and a liquid state.

4. The material of claim 1, wherein the nonflowable state is one or more of a physically rigid state and a semi-rigid state.

5. The material of claim 4, wherein the material is heated from a semi-rigid state to a flowable state.

6. The material of claim 4, wherein the material is heated from a rigid state to a flowable state.

7. The method of claim 1, wherein the material is heated to change its viscosity.

8. The method of claim 1, wherein the channel is provided in an outer element, and the material is conductively cooled by the outer element.

9. The method of claim 1, wherein the material is one or more of a metal and a polymer.

10. The method of claim 1, wherein the material is one or more of an electrically conductive, ferromagnetic, electrically nonconductive, thermally insulating, and thermally conductive material.

11. The method of claim 1, wherein the coil and sheath are configured to minimize heating of the coil in order to maintain the coil temperature within an operating limit.

12. The method of claim 1, wherein the signal is adjusted to provide an alternating heating and cooling cycle.

13. The method of claim 1, wherein:

the signal comprises current pulses providing high frequency harmonics in the coil.

14. The method of claim 1, wherein a flux concentrator is provided to increase the inductive coupling between the coil and the sheath.

15. The method of claim 1, wherein the flux concentrator is disposed inside the coil.

* * * * *